US007198509B2

(12) United States Patent
Takasu

(10) Patent No.: US 7,198,509 B2
(45) Date of Patent: Apr. 3, 2007

(54) COAXIAL CONNECTOR

(75) Inventor: Hideki Takasu, Tokyo (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/115,508

(22) Filed: Apr. 27, 2005

(65) Prior Publication Data

US 2005/0239319 A1 Oct. 27, 2005

(30) Foreign Application Priority Data

Apr. 27, 2004 (JP) ..... 2004-131430

(51) Int. Cl.
*H01R 9/05* (2006.01)

(52) U.S. Cl. ..... 439/485

(58) Field of Classification Search ..... 439/578, 439/581–585, 607, 610, 63, 675
See application file for complete search history.

(56) References Cited

U.S. PATENT DOCUMENTS 4,129,352 A * 12/1978 Iizuka ..... 439/675
5,536,184 A * 7/1996 Wright et al. ..... 439/578
5,691,251 A * 11/1997 Skopic ..... 439/578
6,015,315 A 1/2000 Ensign et al.
6,808,417 B2 * 10/2004 Yoshida ..... 439/585

FOREIGN PATENT DOCUMENTS

JP 5 (1993)- 45962 6/1993
JP 9 (1997) -120870 5/1997

* cited by examiner

*Primary Examiner*—Felix O. Figueroa
(74) *Attorney, Agent, or Firm*—Barley Snyder LLC

(57) ABSTRACT

A coaxial connector, in which control of impedance is facilitated, and in which fluctuations in impedance are extremely small. The coaxial connector includes an inner contact, having a crimp connection portion which is crimped onto an inner conductor of a coaxial cable, an outer contact, which is crimped onto an outer conductor of the coaxial cable and an insulator (dielectric), which is provided between the inner contact and the outer contract. Concavities are formed in the outer surface of the dielectric at positions corresponding to the crimp connection portion of the inner contact The concavities control the characteristic impedance of the coaxial connector.

5 Claims, 4 Drawing Sheets

FIG.5A
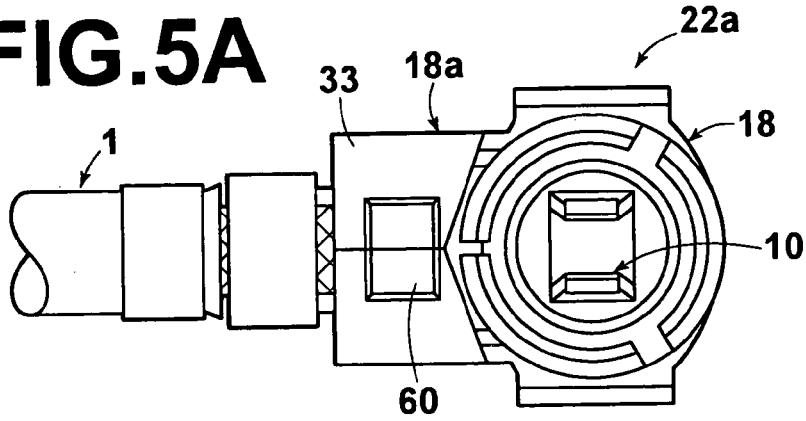
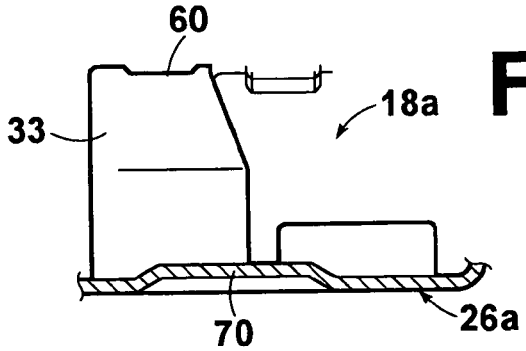
FIG.5B
FIG.6
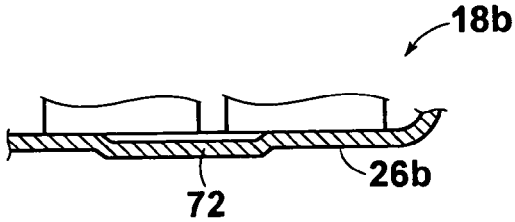
FIG.7
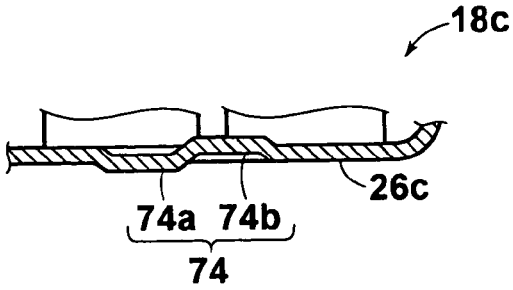

COAXIAL CONNECTOR

FIELD OF THE INVENTION

The present invention relates to an electrical connector, which is utilized in antennas of electronic devices, such as cellular telephones and personal computers. Particularly, the present invention relates to a miniature coaxial connector, in which an inner contact thereof is connected to a central conductor of a coaxial cable by crimping.

BACKGROUND

There is a first known miniature coaxial connector, as disclosed in Japanese Unexamined Patent Publication No. 9(1997)-120870 (FIG. 1C). This connector comprises an inner contact, which is connected to an inner conductor of a coaxial cable by soldering and an outer contact, which is connected to an outer conductor of the coaxial cable by crimping.

There is a second conventional miniature coaxial connector, as disclosed in Japanese Unexamined Utility Model Publication No. 5(1993)-045962 (FIG. 2). This connector comprises an inner contact, which is connected to an inner conductor of a coaxial cable by crush crimping and an outer contact, which is connected to an outer conductor of the coaxial cable by crush crimping. The portion at which the coaxial cable and the inner contact are connected is covered by a cylindrical insulative housing having a substantially uniform thickness.

There is a third known coaxial connector, as disclosed in U.S. Pat. No. 6,015,315 (FIG. 2, FIG. 4). This connector comprises an inner contact, which is soldered onto an inner conductor of a coaxial cable and a cylindrical insulator that covers the periphery of a central connection portion of the inner contact Ribs that extend in the longitudinal direction of the insulator are provided on the inner surface of the insulator, separated in the circumferential direction thereof. The ribs provide spaces between the insulator and the inner contact, thereby increasing characteristic impedance.

In the first known miniature coaxial connector, the inner contact is connected to the inner conductor of the coaxial cable by soldering. Because the amount of solder used varies depending on the person who performs soldering, fluctuations occur in the outer dimensions of the soldered portion. In cases in which signal propagating frequencies are high, the fluctuations may cause characteristic impedance to shift from desired values. In addition, solder utilizes lead, which is not favorable from an ecological viewpoint during disposal thereof In the second known coaxial connector, the inner contact and the outer contact are connected to the coaxial cable by crimping. Because the second coaxial connector does not utilize lead, it is favorable from the ecological viewpoint However, impedance matching in the vicinity of the crimped portion, where the inner contact and the coaxial cable are connected, is not taken into consideration.

The third known coaxial connector has two problems. The first problem is that it utilizes lead, which is not favorable from the ecological viewpoint. The second is that impedance is not uniform along the circumference of the insulator.

SUMMARY

The present invention has been developed in view of the above circumstances. It is an object of the present invention, among others, to provide a coaxial connector, which is capable of easily controlling impedance according to the shape of a portion at which an inner contact and a coaxial cable are connected, and in which fluctuations in impedance are extremely small, due to the fact that solder is not utilized to connect the coaxial cable and the contact.

The coaxial connector of the present invention has an inner contact, comprising a crimp connection portion which is crimped onto an inner conductor of a coaxial cable, an outer contact, which is crimped onto an outer conductor of the coaxial cable and a dielectric, which is provided between the inner contact and the outer contact Concavities are formed in the outer surface of the dielectric at portions corresponding to the crimp connection portion of the inner contact and the concavities control characteristic impedance.

BRIEF DESCRIPTION OF THE DRAWINGS

FIG. 1A and FIG. 1B illustrate a coaxial cable having an inner contact connected to an inner conductor of a coaxial cable, wherein FIG. 1A is a front view, and FIG. 1B is a plan view.

FIG. 2A and FIG. 2B illustrate an embodiment of a coaxial connector according to the invention mounted onto the end of the coaxial cable of FIG. 1, wherein FIG. 2A is a front view, and FIG. 2B is a plan view.

FIG. 3A and FIG. 3B are sectional views of the coaxial connector of FIG. 2A, wherein FIG. 3A is a sectional view taken along line 3*a*—3*a* of FIG. 2B, and FIG. 3B is a sectional view taken along line 3*b*—3*b* of FIG. 2A.

FIG. 4A, FIG. 4B, and FIG. 4C illustrate an insulator utilized by the coaxial connector of FIG. 2A, wherein FIG. 4A is a plan view, FIG. 4B is a bottom view, and FIG. 4C is a sectional view taken along line 4C—4C of FIG. 4A.

FIG. 5A and FIG. 5B illustrate a coaxial connector according to a second embodiment of the invention, wherein FIG. 5A is a plan view, and FIG. 5B is a partial sectional view of an outer contact prior to crimping.

FIG. 6 is a partial sectional view of a main body portion of an outer contact, which is utilized in a coaxial connector according to a third embodiment of the invention.

FIG. 7 is a partial sectional view of a main body portion of an outer contact, which is utilized in a coaxial connector according to a fourth embodiment of the invention.

DETAILED DESCRIPTION OF THE EMBODIMENTS

Figure 1A:
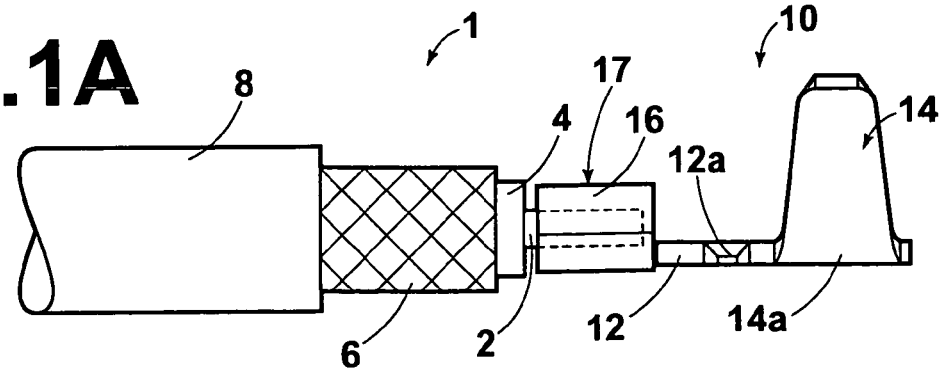
Figure 1B:
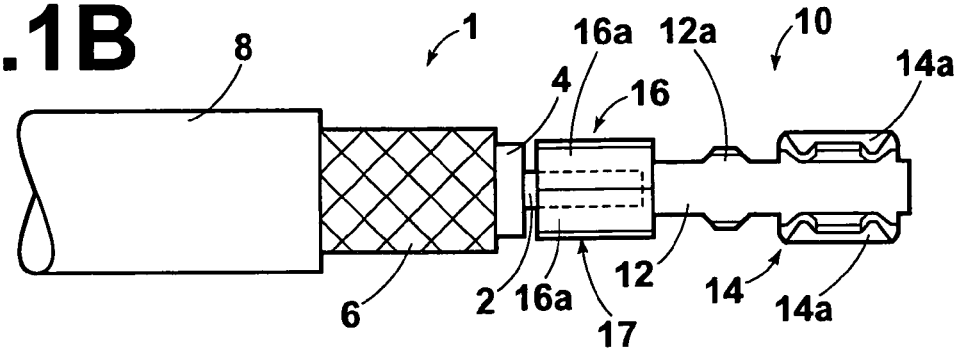

Hereinafter, embodiments of a coaxial connector according to the present invention will be described with reference to the attached drawings. As illustrated in FIG. 1A and FIG. 1B, the coaxial cable 1 comprises a central conductor 2, a dielectric 4 that houses the central conductor 2 therein, a braided wire 6 (outer conductor) that covers the outer periphery of the dielectric 4 and an insulative jacket 8 that covers the outer periphery of the braided wire 6. The inner contact 10 is crimped onto the central conductor 2, which is exposed at the tip of the dielectric 4.

The inner contact 10 is formed by stamping and forming a metal plate. The inner contact 10 comprises abase portion 12 that extends in the longitudinal direction of the coaxial cable 1, a contact portion 14, for electrically connecting with an inner contact of another connector (not shown), provided at a first end of the base portion 12 and a crimp barrel 16 provided at a second end of the base portion 12. The contact portion 14 is formed by a pair of substantially parallel contact pieces 14*a* and 14*a*, which protrude from the base portion 12 at right angles. The crimp barrel 16 is formed by a pair of crimp pieces 16*a* and 16*a*, which protrude from both lateral edges of the base portion 12. The central conductor 2 is housed within the crimp pieces 16*a* and 16*a* The crimp pieces 16*a* and 16*a* are crushed and crimped onto the central conductor 2, to form a crimp connection portion 17. In the case of crush crimping, the central conductor 2 is positioned substantially at the center of the crushed crimp barrel 16 when viewed from the axial direction of the coaxial cable 1 (refer to FIG. 3B). Accordingly, this manner of connection is particularly favorable in the case that the central conductor 2 is thin. Note that protrusions 12*a* and 12*a*, which have substantially the same plate thickness as the base portion 12, protrude from both lateral edges of the base portion 12 between the contact portion 14 and the crimp barrel 16.

Figure 2A:
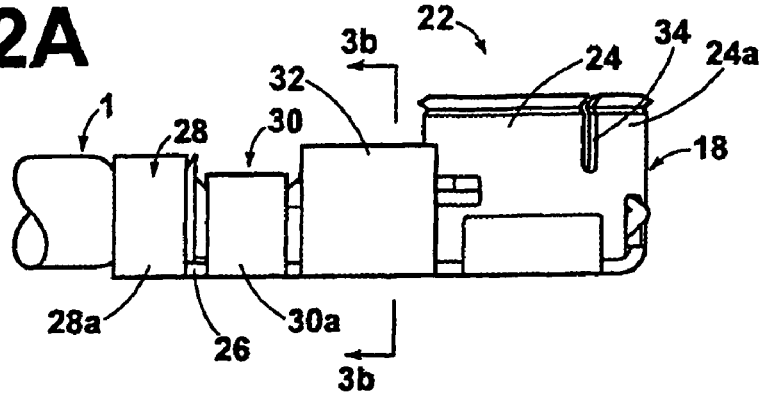
Figure 2B:
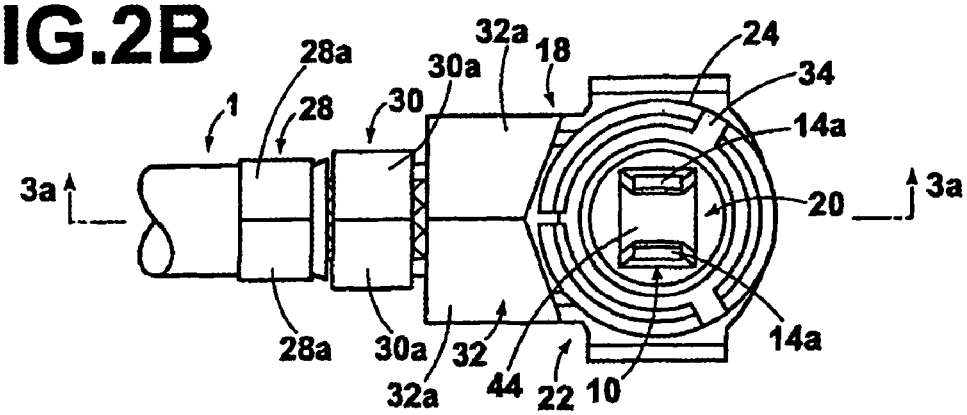

Next, a coaxial connector 22, having an outer contact 18 which is mounted to an end of the coaxial cable 1 via an insulator 20 (dielectric), will be described with reference to FIG. 2A and FIG. 2B. The outer contact 18 is formed by stamping and forming a single metal plate, and comprises an elongate main body 26 that extends in the axial direction of the coaxial cable 1. A substantially cylindrical engaging portion 24, for engaging another connector, is formed at a first end of the main body 26. An insulative crimp barrel 28, formed with crimp pieces 28*a* and 28*a*, which are to be crimped onto the jacket 8 of the coaxial cable 1, is formed at a second end of the main body 26. The crimp pieces 28*a* and 28*a* extend upward from the main body 26 prior to being crimped onto the jacket 8, so as to be capable of receiving the jacket 8 therebetween.

A conductive barrel 30, which is to be crimped onto the braided wire 6, is formed adjacent to the crimp barrel 28 toward the tip of the coaxial cable 1. The conductive barrel 30 is formed with a pair of crimp pieces 30*a* and 30*a*, in a manner similar to that of the crimp barrel 28. A holding barrel 32, which is to be crimped onto the insulator 20 (to be described later), is provided between the conductive barrel 30 and the engaging portion 24. The holding barrel 32 is also formed with a pair of crimp pieces 32*a* and 32*a* The holding barrel 32 has a rectangular sectional shape when crimped, and functions to hold the insulator 20 therein. The holding barrel 32 is positioned to the exterior of the crimp barrel 16 of the inner contact 10. The engaging portion 24 is cylindrical, and vertically extending cutouts 34 are formed at three locations along the periphery thereof The cutouts 34 impart elasticity to a distal end portion 24*a* of the engaging portion 24. FIG. 2B illustrates the insulator 20 within the engaging portion 24 and the contact pieces 14*a* and 14*a* of the inner contact 10, positioned within an engaging aperture 44 of the insulator 20.

Next, the insulator 20 will be described with reference to FIG. 3A, FIG. 3B, FIG. 4A, FIG. 4B, and FIG. 4C. The insulator 20 is formed by integrally molding a suitable insulative material such as a polyolefin resin, such as polypropylene and polyethylene, and comprises a substantially planar cover 36, and abase 40, which is integrally linked to the cover 36 by a hinge 38. The cover 36 is of a shape that matches the circular outer contour of the engaging portion 24. That is, a portion of each of both lateral edges of the cover 36 is swollen outward in an arcuate manner. A rectangular concavity 42 is formed in an outer surface 36*a* of the cover 36. A groove 56, for receiving the base portion 12 of the inner contact 10, is formed in the inner surface 36*b* of the cover 36, extending along the longitudinal direction thereof Meanwhile, an engaging portion 24, formed with the vertically extending engaging aperture 44, is formed in the base 40. As mentioned previously, the contact portion 14 of the inner contact 10 is positioned within the engaging aperture 44. A horizontal portion 46 extends from the end of the lower portion of the engaging portion 24 opposite from the hinge 38. A groove 48, for receiving the base portion 12 of the inner contact 10, and recesses 48*a*, for receiving the protrusions 12*a*, are formed in the horizontal portion 46. The inner contact 10 is positioned in its longitudinal direction and centered in the direction perpendicular thereto, by being positioned within the groove 48 and the recesses 48*a*

A crimp barrel housing portion 50 is formed at the end of the horizontal portion 46. A rectangular concavity 54 is formed on an outer surface 36*c* of a wall 52 of the crimp barrel housing portion 50. The inner contact 10 is held within the insulator 20, by bending the cover 36 and the base 40 toward each other in a state in which the inner contact 10, which has been crimped onto the coaxial cable 1, is placed between the cover 36 and the base 40. Then, when the outer contact 18 is crimped onto the coaxial cable 1 and the insulator 20, the cross section becomes that which is illustrated in FIG. 3B. The coaxial connector 22 is suited for high frequency signal propagation, for example, up to about 6 GHz.

What is important here is that the concavities 54 and 42 of the insulator 20 are positioned above and below the crimp barrel 16, which has been crimped onto the central conductor 2, that is, the crimp connection portion 17. Thereby, the walls 52 and 58 of the insulator 20 adjacent to the crimp connection portion 17 become thin. As a result, the dielectric constant and the capacitance in the periphery of the crimp connection portion 17 decrease, due to the air layers within the concavities 42 and 54. Accordingly, the impedance in these regions is increased. That is, a desired impedance can be obtained by varying the deepness of the concavities 42 and 54. In the present embodiment, the concavities 42 and 54 are 0.2 mm deep and 0.3 mm deep, respectively.

Figure 3A:
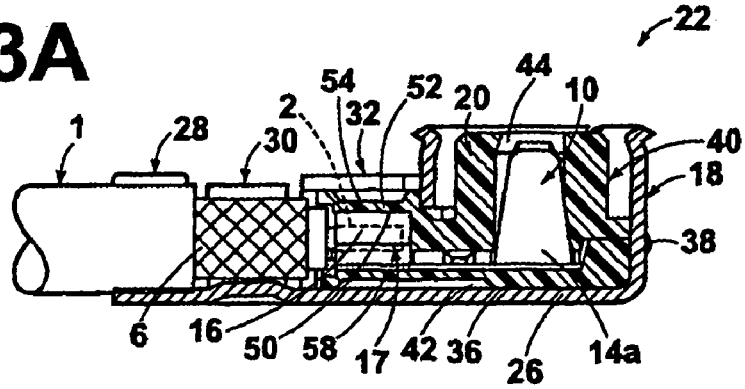
Figure 3B:
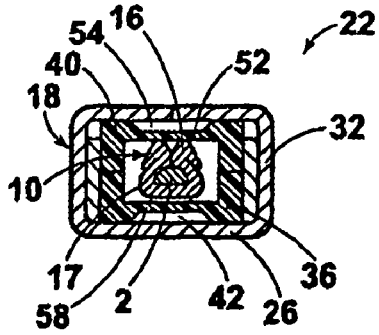
Figure 4A:
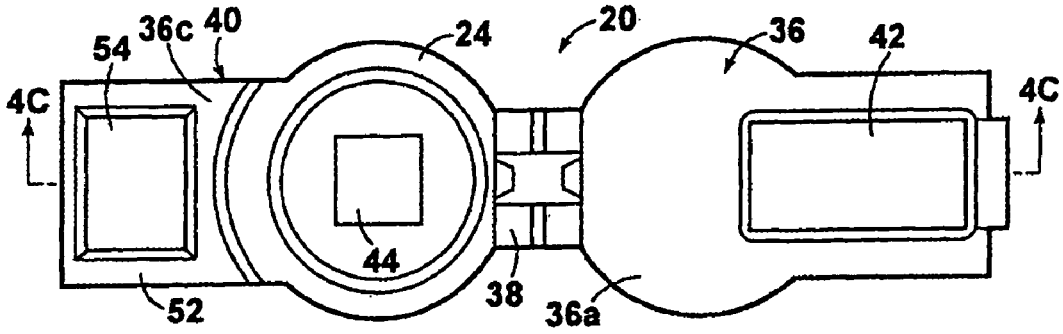
Figure 4B:
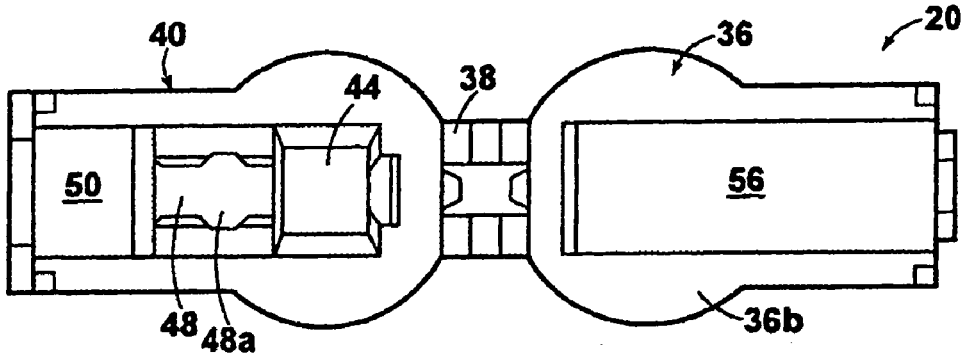
Figure 4C:
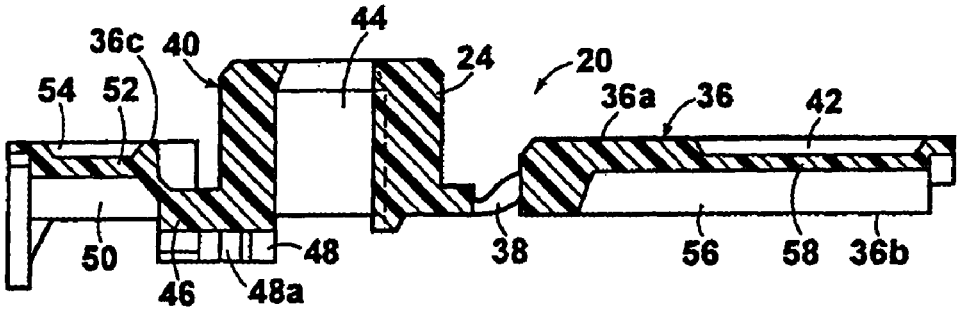

Note that in the present embodiment illustrated in FIG. 3A and FIG. 3B, the main body 26 of the outer contact 18 that corresponds to the concavity 42 is flat However, the impedance may be more finely adjusted by varying the shape of the main body 26. A second embodiment of the present invention will be described with reference to FIG. 5A and FIG. 5B. In the second embodiment, a caved portion 60 is formed in a holding barrel 33 of the outer contact 18*a*, and a caved portion 70 is formed in a main body 26*a* The caved portion 60 is formed at a portion of the holding barrel 33 that corresponds in position to the concavity 54 of the insulator 20, and the caved portion 70 is formed at a portion of the main body portion 26*a* that corresponds in position to the concavity 42. The caved portions 60, 70 cause the spaces, which are formed by the concavities 42 and 54, to be reduced or eliminated. Thereby, the dielectric constant in these areas increase, and the impedance decreases. Accordingly, the second embodiment is suited to finely adjusting impedance in the downward direction.

Next, a third embodiment of the present invention will be described with reference to FIG. 6. FIG. 6 is a partial sectional view of a main body 26*b* of an outer contact 18*b*, which is utilized in the coaxial connector according to the third embodiment of the present invention. In the third embodiment illustrated in FIG. 6, a swollen portion 72, which protrudes toward the exterior of the main body 26*b*, is formed on the outer contact 18*b*. The swollen portion 72 increases the space within the concavity 42, thereby decreasing the dielectric constant and increasing the impedance therein. This method may be adopted in cases that impedance was not increased sufficiently by only the concavity 42 in the insulator 20.

A fourth embodiment of the present invention will be described with reference to FIG. 7. FIG. 7 is a partial sectional view of a main body 26*c* of an outer contact 18*c*, which is utilized in the coaxial connector according to the fourth embodiment of the present invention. In the fourth embodiment illustrated in FIG. 7, the portion of the outer contact 18*c* that corresponds in position to the crimp connection portion 17 is protruded outward to form a swollen portion 74*a* In addition, the portion of the outer contact 18*c* that corresponds in position to the base portion 12 of the inner contact 10, which is smaller than the crimp contact portion 17 in outer dimensions such as width and height, is protruded inward to form a caved portion 74*b*. The swollen portion 74*a* and the caved portion 74*b* formed an uneven portion 74. Impedance is increased at the swollen portion 74*a*, and decreased at the caved portion 74*b*. By varying the shape of the outer contact 18*c* corresponding to the outer dimensions along the electrical path of the inner contact 10, the impedance along the electrical path become aligned, to enable even finer adjustments to the impedance.

Control of impedance, that is, increase or decrease thereof, is facilitated by the concavities 42, 54, which are formed in the outer surface of the dielectric according to the shape of the crimp connection portion 17 at which the inner contact 10 is crimped onto the central conductor 2 of the coaxial cable 1. This, in combination with the fact that solder is not utilized to connect the inner contact 10 and the coaxial cable 1, provides a low profile coaxial connector, in which fluctuations in impedance are extremely small.

Caved portions 60, 70, for decreasing the distance between the outer contact and the concavities 42, 54 of the dielectric, may be provided at regions of the outer contact that correspond to the concavities. In this case, the air layers within the concavities are reduced, capacitance is increased, and impedance is decreased. This is because the insulator 20, which has a higher dielectric constant than air, is positioned within the cavities. Accordingly, the provision of the caved portions 60, 70 is effective in cases that a desired impedance is to be obtained by finely adjusting the impedance downward.

Alternatively, swollen portions 72, for increasing the distance between the outer contact and the concavities 42 of the dielectric, may be provided at regions of the outer contact that correspond to the concavities 42. In this case, the air layers within the concavities 42 are enlarged, capacitance is decreased, and impedance is increased. This is because the enlargement of the air layer decreases the combined dielectric constant within the regions corresponding to the concavities. Accordingly, the provision of the swollen portions is effective in cases that a desired impedance is to be obtained by finely adjusting the impedance upward.

Further, uneven portions 74, for increasing and decreasing the distance between the outer contact and the concavities of the dielectric, may be provided at regions of the outer contact that correspond to the concavities; wherein the uneven portions correspond to the outer dimensions along the electrical path of the inner contact, which is crimped onto the inner conductor. In this case, a desired impedance may be more effectively obtained.

What is claimed is:

1. A coaxial connector, comprising:

an inner contact having a crimp connection portion which is crimped onto an inner conductor of a coaxial cable;

an outer contact which is crimped onto an outer conductor of the coaxial cable;

a dielectric which is provided between the inner contact and the outer contact;

at least one concavity formed in an outer surface of the dielectric at the crimp connection portion of the inner contact; and the outer contact having a swollen portion located at the concavity for increasing the distance between the outer contact and the concavity.

2. A coaxial connector, comprising:

an inner contact having a crimp connection portion which is crimped onto an inner conductor of a coaxial cable;

an outer contact crimped onto an outer conductor of the coaxial cable;

a dielectric provided between the inner contact and the outer contact;

at least one concavity formed in an outer surface of the dielectric at the crimp connection portion of the inner contact, the inner surface of the outer contact being continuous at the concavity, the concavity forming a space between an inner surface of the outer contact and the outer surface of the dielectric to increase impedance;

a swollen portion extending away from the dielectric formed on the outer contact at a region that corresponds to the concavity that further increases the space between the inner surface of the outer contact and the outer surface of the dielectric to further increase impedance; and a caved portion formed on the outer contact at least at a region that corresponds to a base portion of the inner contact, the caved portion decreasing the space between the inner surface of the outer contact and the outer surface of the dielectric to decrease impedance at the caved portion.

3. The coaxial connector as defined in claim 2, wherein the dielectric includes two of the concavities, one of the concavities being formed below the crimp connection portion and one of the cavities being formed above the crimp connection portion.

4. A coaxial connector as defined in claim 2, wherein the dielectric includes a base and a cover, the base and the cover being bendable about a hinge.

5. A coaxial connector as defined in claim 4, wherein the dielectric includes two of the concavities, the base and the cover each being provided with one of the concavities.

* * * * *